US007223946B2

(12) United States Patent
Schnaibel et al.

(10) Patent No.: US 7,223,946 B2
(45) Date of Patent: May 29, 2007

(54) METHOD AND DEVICE FOR CONTROL AND DIAGNOSIS FOR THE HEATING OF A LAMBDA PROBE

(75) Inventors: Eberhard Schnaibel, Hemmingen (DE); Andreas Koring, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/246,862

(22) Filed: Oct. 7, 2005

(65) Prior Publication Data

US 2006/0086733 A1 Apr. 27, 2006

(30) Foreign Application Priority Data

Oct. 7, 2004 (DE) ..... 10 2004 048 859

(51) Int. Cl.
*H05B 1/02* (2006.01)

(52) U.S. Cl. ..... 219/497; 219/499; 219/501; 219/206; 219/506; 123/697; 123/676

(58) Field of Classification Search ..... 219/494, 219/497, 505, 202, 206, 501, 506, 499; 123/697, 123/676, 703, 672
See application file for complete search history.

(56) References Cited

U.S. PATENT DOCUMENTS 5,067,465 A * 11/1991 Yamasaki et al. ..... 123/677
5,245,979 A * 9/1993 Pursifull et al. ..... 123/690
5,671,721 A * 9/1997 Aoki ..... 123/688
6,409,969 B1 * 6/2002 Streicher et al. ..... 422/94

FOREIGN PATENT DOCUMENTS

DE 39 28 709 3/1991

* cited by examiner

*Primary Examiner*—Mark Paschall
(74) *Attorney, Agent, or Firm*—Kenyon & Kenyon LLP

(57) ABSTRACT

A method for controlling and regulating an electrical heating of a probe situated in the exhaust system of an internal combustion engine, a total heating power of the probe being set, and an actual temperature value of the probe being determined by measuring a characteristic parameter, e.g., a resistance. To prevent overheating of the probe ceramics, and therefore over-compensation of aging effects when using such a method, a rated heating power is determined by way of a program map as a function of operating points of the internal combustion engine; a control heating power is determined from the actual temperature value and a new setpoint value in a controller; and the total heating power is formed as the sum of the rated heating power and the control heating power. Moreover, due to this procedure, the regulating reserve of the controller is retained in wide ranges of the operating points. A cost advantage is yielded, because a measuring resistor and an analog-to-digital converter can be omitted. Also, a device for controlling and regulating an electrical heating of a probe situated in the exhaust system of an internal combustion engine, for implementing the method. Because a program map and a controller are connected via a summing stage, a particularly simply constructed device is provided which prevents overheating of the exhaust gas analyzer probe.

11 Claims, 1 Drawing Sheet

METHOD AND DEVICE FOR CONTROL AND DIAGNOSIS FOR THE HEATING OF A LAMBDA PROBE

FIELD OF THE INVENTION

The present invention relates to a method for controlling and regulating an electrical heating of a probe situated in the exhaust system of an internal combustion engine, a total heating power of the probe being set, and an actual temperature value of the probe being determined by measuring a characteristic parameter, e.g., a resistance.

The present invention further relates to a device for controlling and regulating an electrical heating of a probe situated in the exhaust system of an internal combustion engine, for implementing the method.

BACKGROUND INFORMATION

In modern motor vehicles, as a rule, at least one sensor is situated in the exhaust system of the combustion engine, the sensor first being operational after a specific temperature is exceeded. For example, the sensor may be a lambda probe. The sensor is heated by the hot exhaust gases blowing past. In operation, it should have a nominal temperature of typically 750° C. In order to reach the minimum temperature of the sensor as quickly as possibly after the start, and also to ensure the minimum temperature in operating ranges in which the heating power of the exhaust gases alone is not sufficient for that purpose, it is customary to provide the sensor with an electrical heating device. In the event of a defect in the heating device, the operativeness of the sensor may be sharply restricted.

German Patent Application No. DE 39 28 709 describes a method and a device for checking the operativeness of a heating device for the exhaust gas analyzer probe and its leads. In that case, after the heating device is switched on, the readiness of the exhaust gas analyzer probe for operation is determined at two successive times. If it is not ready for operation after the first time has elapsed and is operationally ready after the second time has elapsed, a malfunction of the heating device is inferred. This function diagnosis is based on the assumption that the exhaust gas analyzer probe reaches its minimum operating temperature more quickly when the heating device is switched on and operating correctly, than when heated up solely by the exhaust gases. Thus, this method is suitable for checking the readiness of the exhaust gas analyzer probe for operation. Requirements of the California Air Resources Board CARB, which require that the malfunction of parts relevant to the exhaust gas (among which is also the probe heating) be detected and indicated, are thereby satisfied. Meanwhile, in the European market, it is also mandatory to monitor the heating current or an alternative variable.

An object of the present invention is to provide a method which determines the rated heating power and control heating power of an electrical heating of a probe situated in the exhaust system of an internal combustion engine, and monitors the total heating power as the sum of both, such that overheating of the probe is prevented.

It is a further object of the present invention to provide a device for implementing the method.

SUMMARY OF THE INVENTION

The objective is achieved in that a rated heating power is determined by way of a program map as a function of operating points of the internal combustion engine; that a control heating power is determined from the actual temperature value and a new setpoint value in a controller; and that the total heating power is formed as the sum of the rated heating power and the control heating power. By this procedure, overheating of the probe ceramics, and therefore over-compensation of ageing effects is prevented. Moreover, the regulating reserve of the controller is retained in wide ranges of the operating points. A cost advantage is yielded, because a measuring resistor and an analog-to-digital converter may be omitted.

The method may be implemented particularly cost-effectively, in that the actual temperature value of the probe is determined by measuring the internal resistance of the probe.

If the temperature-determining parameter is tracked so that the heating power remains stable, it is possible to retain the regulating reserve of the controller over an especially wide range of operating points. In this context, the tracking denotes a type of correction of the temperature-determining parameter.

One simple embodiment of the method provides that the temperature-determining parameter is the new setpoint value or the actual temperature value.

A distinction between a change in the Nernst cell characteristic and a decrease in the heating power, e.g., through shunts, is achieved, in that the dynamics of the change in the control heating power are used to diagnose a faulty heating (decrease of heating power).

One simplified and nevertheless reliable further development of the method provides that a faulty or aged probe is determined by the fact that the change in the actual temperature value reaches a maximum amount.

Changes in the Nernst cell characteristic are separated from a decrease in the heating power, by carrying out the tracking of the actual temperature value markedly more slowly than the tracking of the control heating power.

One further development of the method, advantageous in the case of maintenance, provides that the exchange of probes is detected by evaluating the control heating power, since one possible source of error is avoided in the case of a probe exchange.

If the controller parameters are established as a function of the operating points, it is possible to achieve an especially small deviation of the probe temperature from the setpoint value.

The objective regarding the device is achieved in that a program map and a controller are connected via a summing stage. A particularly simply constructed device is thereby created, which prevents the exhaust gas analyzer probe from overheating.

DETAILED DESCRIPTION

Figure 1:
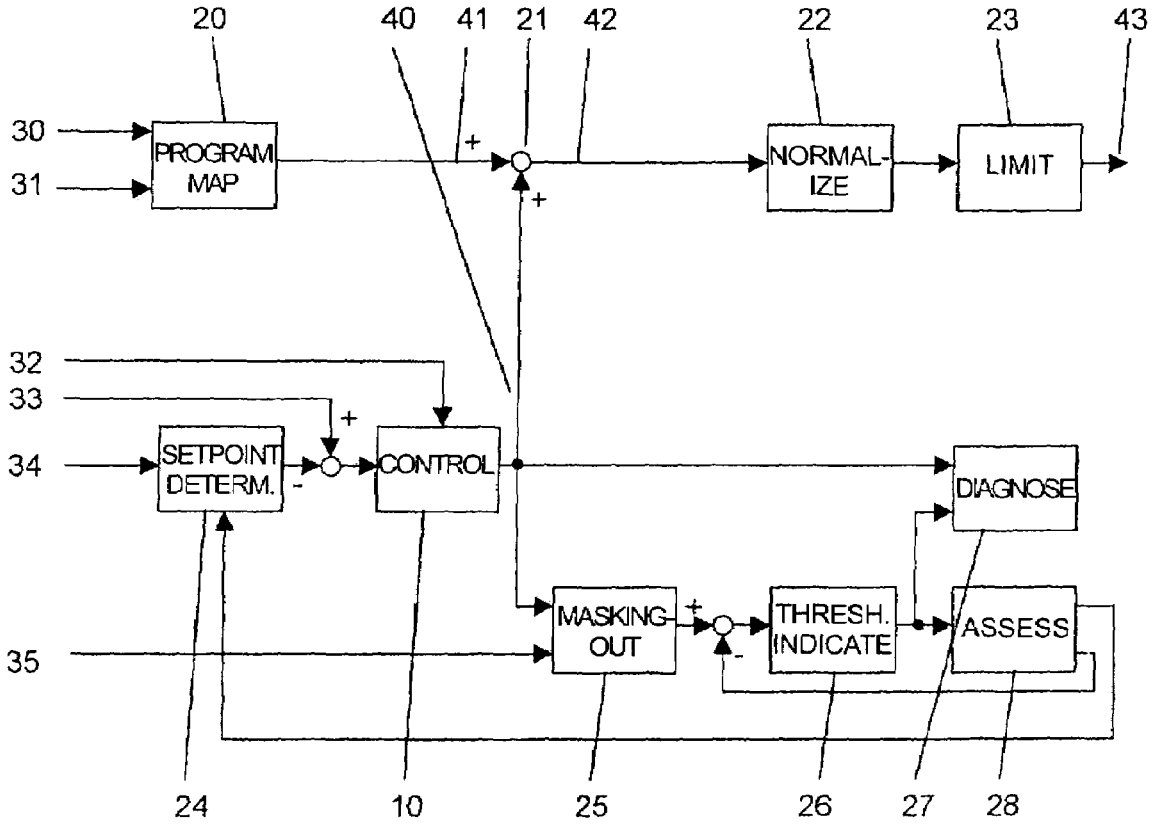
FIG. 1 shows a basic representation in the form of a highly schematized block diagram of the technical environment in which the present invention may be used.

FIG. 1 shows a schematized representation of the technical environment in which the present invention may be used. A rated heating power (41) for a new probe having a nominal Nernst cell characteristic is output by way of a program map (20) as a function of various operating points (30, 31) of the internal combustion engine. For example, operating points (30, 31) may be the engine speed and/or the load and/or the exhaust-gas temperature and/or the exhaust-gas mass flow. Thus, program map (20) has the character of a precontrol. Superimposed on this precontrol is a controller (10) which compensates for the remaining difference between actual temperature value (33) and nominal setpoint value (34) (for example, 750°, as discussed above) by measuring the internal resistance of the probe. The heating power necessary for this purpose is referred to as control heating power (40). Total heating power (42) resulting therefrom is formed in a summing stage (21) and fed to a probe via a normalization (22) and a limitation (23) with a duty factor (43) determined from the aforesaid values.

Controller (10) may also be influenced by control parameters (32) not specified more precisely here. For instance, if the temperature-determining parameter is tracked so that the heating power remains stable, it is possible to retain the regulating reserve of controller (10) over a wide range of operating points. It may be provided that the temperature-determining parameter is new nominal setpoint value (34), which is used as correction of setpoint-value temperature determination (24). The rate of change (35) of control heating power (40) is the input quantity for masking-out (gating, suppression, extraction) (25). A downstream threshold-value indicator (26) forms setpoint-value temperature determination (24) from the difference between masking-out (25) and assessment (28). By way of a diagnosis (27) for the aging of the probe, the dynamics of the change in control heating power (40) may be used for indicating a faulty heating, in that the change in the Nemst cell characteristic and the decrease in heating power are differentiated.

What is claimed is:

1. A method for controlling and regulating an electrical heating of a probe situated in an exhaust system of an internal combustion engine, the method comprising:

setting a total heating power of the probe;

determining an actual temperature value of the probe by measuring a characteristic parameter;

determining a rated heating power by way of a program map as a function of operating points of the internal combustion engine;

determining a control heating power from the actual temperature value and a nominal setpoint value in a controller, wherein the total heating power is formed as a sum of the rated heating power and the control heating power;

determining a rate of change of the control heating power; and modifying the nominal setpoint value used to determine the control heating power, the modifying based on the determined rate of change of the control heating power.

2. The method according to claim 1, wherein the actual temperature value of the probe is determined by measuring an internal resistance of the probe.

3. The method according to claim 1, further comprising tracking a temperature-determining parameter in such a way that the heating power remains stable.

4. The method according to claim 3, wherein the temperature-determining parameter is one of the nominal setpoint value and the actual temperature value.

5. The method according to claim 1, further comprising using dynamics of a change in the control heating power for diagnosing at least one of a faulty heating and a decrease of heating power.

6. The method according to claim 1, further comprising determining one of a faulty and aged probe, in that a change in the actual temperature value reaches a maximum amount.

7. The method according to claim 1, further comprising carrying out a tracking of the actual temperature value substantially more slowly than a tracking of the control heating power.

8. The method according to claim 1, further comprising detecting an exchange of probes by evaluating the control heating power.

9. The method according to claim 1, further comprising establishing controller parameters of the controller as a function of the operating points.

10. The method according to claim 1, wherein the characteristic parameter is a resistance.

11. A device for controlling and regulating an electrical heating of a probe situated in an exhaust system of an internal combustion engine, the device comprising:

means for setting a total heating power of the probe;

means for determining an actual temperature value of the probe by measuring a characteristic parameter;

a program map enabling a rated heating power to be determined as a function of operating points of the engine;

a controller for determining a control heating power from the actual temperature value and a nominal setpoint value; and a summing stage connecting the program map and the controller, wherein the total heating power is formed as a sum of the rated heating power and the control heating power, and means for determining a rate of change of the control heating power; and means for modifying the nominal setpoint value used to determine the control heating power, the means for modifying using the determined rate of change of the control heating power.

* * * * *